US006617049B2

(12) United States Patent
Darolia et al.

(10) Patent No.: US 6,617,049 B2
(45) Date of Patent: Sep. 9, 2003

(54) THERMAL BARRIER COATING WITH IMPROVED EROSION AND IMPACT RESISTANCE

(75) Inventors: Ramgopal Darolia, West Chester, OH (US); Joseph David Rigney, Milford, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/765,227

(22) Filed: Jan. 18, 2001

(65) Prior Publication Data

US 2003/0138660 A1 Jul. 24, 2003

(51) Int. Cl.[7] ..... B32B 15/04; F03B 3/12

(52) U.S. Cl. ..... 428/633; 428/632; 428/680; 428/469; 428/697; 428/699; 428/701; 428/702; 428/332; 416/241 B

(58) Field of Search ..... 428/325, 332, 428/621, 632, 633, 675, 679, 469, 699, 680, 697, 702, 701; 416/241 R, 241 B

(56) References Cited

U.S. PATENT DOCUMENTS 4,112,137 A 9/1978 Zega
4,774,150 A 9/1988 Amano et al.
4,996,117 A 2/1991 Chu et al.
5,059,095 A * 10/1991 Kushner et al.
5,209,645 A * 5/1993 Kojima et al.
5,296,274 A 3/1994 Movchan et al.
5,418,003 A 5/1995 Bruce et al.
5,474,809 A 12/1995 Skelly et al.
5,512,382 A 4/1996 Strangman
5,562,998 A 10/1996 Strangman
5,683,825 A * 11/1997 Bruce et al.
5,773,078 A 6/1998 Skelly
5,792,521 A 8/1998 Wortman
5,834,070 A 11/1998 Movchan et al.
6,042,951 A * 3/2000 Kojima et al.
6,103,386 A 8/2000 Raybould et al. ..... 428/472
6,274,215 B1 * 8/2001 Brainch et al.
6,382,920 B1 * 5/2002 Dopper

* cited by examiner

*Primary Examiner*—Deborah Jones
*Assistant Examiner*—Jennifer McNeil
(74) *Attorney, Agent, or Firm*—David L. Narciso; Gary M. Hartman; Domenica N. S. Hartman

(57) ABSTRACT

A thermal barrier coating (TBC) for a component intended for use in a hostile environment, such as the superalloy turbine, combustor and augmentor components of a gas turbine engine. The TBC is formed of at least partially stabilized zirconia, preferably yttria-stabilized zirconia (YSZ), and exhibits improved erosion and impact resistance as a result of containing a dispersion of alumina precipitates or particles. The TBC preferably consists essentially of YSZ and the alumina particles, which are preferably dispersed throughout the microstructure of the TBC, including the YSZ grains and grain boundaries. The alumina particles are present in an amount sufficient to increase the impact and erosion resistance of the TBC, preferably at least 5 volume percent of the TBC.

11 Claims, 2 Drawing Sheets

THERMAL BARRIER COATING WITH IMPROVED EROSION AND IMPACT RESISTANCE

FIELD OF THE INVENTION

This invention relates to protective coatings for components exposed to high temperatures, such as the hostile thermal environment of a gas turbine engine. More particularly, this invention is directed to a thermal barrier coating (TBC) formed of a zirconia-based ceramic material that exhibits improved erosion and impact resistance as a result of containing a dispersion of alumina particles or precipitates.

BACKGROUND OF THE INVENTION

Higher operating temperatures for gas turbine engines are continuously sought in order to increase their efficiency. However, as operating temperatures increase, the high temperature durability of the components within the hot gas path of the engine must correspondingly increase. Significant advances in high temperature capabilities have been achieved through the formulation of nickel and cobalt-base superalloys. Nonetheless, when used to form components of the turbine, combustor and augmentor sections of a gas turbine engine, such alloys alone are often susceptible to thermal damage and oxidation and hot corrosion attack, and may not retain adequate mechanical properties. For this reason, these components are often protected by a thermal barrier coating (TBC) system. TBC systems typically include an environmentally-protective bond coat and a thermal-insulating ceramic topcoat, typically referred to as the TBC. Bond coat materials widely used in TBC systems include overlay coatings such as MCrAlX (where M is iron, cobalt and/or nickel, and X is yttrium or another rare earth or reactive element such as hafnium, zirconium, etc.), and diffusion coatings such as diffusion aluminides, notable examples of which are NiAl and NiAl(Pt).

Ceramic materials and particularly binary yttria-stabilized zirconia (YSZ) are widely used as TBC materials because of their high temperature capability, low thermal conductivity, and relative ease of deposition by plasma spraying, flame spraying and physical vapor deposition (PVD) techniques. TBC's employed in the highest temperature regions of gas turbine engines are often deposited by electron beam physical vapor deposition (EBPVD), which yields a columnar, strain-tolerant grain structure that is able to expand and contract without causing damaging stresses that lead to spallation of the TBC. Similar columnar microstructures can be produced using other atomic and molecular vapor processes, such as sputtering (e.g., high and low pressure, standard or collimated plume), ion plasma deposition, and all forms of melting and evaporation deposition processes (e.g., cathodic arc, laser melting, etc.). In contrast, plasma spraying techniques such as air plasma spraying (APS) deposit TBC material in the form of molten "splats," resulting in a TBC characterized by flat (noncolumnar) grains and a degree of inhomogeneity and porosity that reduces heat transfer through the TBC.

While YSZ TBC's are widely employed in the art for their desirable thermal and adhesion characteristics, they are susceptible to chemical and mechanical damage within the hot gas path of a gas turbine engine. In U.S. Pat. No. 4,996,117 to Chu et al., a YSZ TBC is disclosed whose individual grains are enveloped by a coating of zirconium silicate (zircon; $ZrSiO_4$), silicon dioxide (silica; $SiO_2$), aluminum oxide (alumina; $Al_2O_3$), aluminum silicate ($SiO_2/Al_2O_3$) and/or aluminum titanate ($Al_2O_3/TiO_2$) that protects the YSZ from corrosion, such as from attack by vanadium pentoxide. In terms of mechanical damage, YSZ coatings on gas turbine engine components are known to be susceptible to thinning from impact and erosion damage by hard particles in the high velocity gas path. Impact damage and the resulting loss of TBC particularly occur along the leading edges of components such as turbine blades, while erosion is more prevalent on the concave and convex surfaces of the blades, depending on the particular blade design. Both forms of mechanical damage not only shorten component life, but also lead to reduced engine performance and fuel efficiency.

Though mechanical damage such as erosion can be addressed by increasing the thickness of the TBC, a significant drawback is the additional mass added to the blade, resulting in higher centripetal loads that must be carried by a consequently heavier disk. Consequently, other solutions are necessary to achieve an impact and erosion-resistant TBC with an acceptable thickness, preferably less than 250 micrometers. Such attempts have included thermally treating the outer surface of the ceramic TBC material or providing an additional erosion-resistant outer coating. Suggested materials for more erosion-resistant outer coatings have included zircon, silica, chromia ($Cr_2O_3$) and alumina. While various methods and apparatuses are capable of sequentially depositing layers of different materials, a difficulty has been a tradeoff between spallation resistance and thermal conductivity. Spallation resistance is generally reduced by the presence of abrupt compositional changes at the interfaces between layers. On the other hand, and as discussed in U.S. Pat. No. 5,792,521 to Wortman, if the interfaces between layers are characterized by localized compositional gradients containing mixtures of the different deposited materials, the interface offers a poorer barrier to thermal conduction as compared to a distinct compositional interface in which minimal intermixing exists.

In view of the above, further improvements in TBC technology are desirable, particularly as TBC's are employed to thermally insulate components intended for more demanding engine designs.

BRIEF SUMMARY OF THE INVENTION

The present invention generally provides a thermal barrier coating (TBC) for a component intended for use in a hostile environment, such as the superalloy turbine, combustor and augmentor components of a gas turbine engine. The TBC of this invention exhibits improved erosion and impact resistance as a result of containing a dispersion of alumina particles or precipitates (hereinafter referred to simply as particles). The TBC preferably consists essentially of yttria-stabilized zirconia and the alumina particles, which are dispersed throughout the microstructure of the TBC including the YSZ grains and grain boundaries. Importantly, the alumina particles are present in an amount sufficient to increase the impact and erosion resistance of the TBC, preferably at least 5 volume percent of the TBC.

In the form of discrete particles in the above-noted amount, sufficient alumina is present as a dispersion to increase the impact and erosion resistance of the TBC while avoiding the presence of localized compositional gradients that would decrease the spallation resistance of the TBC. The alumina particles serve to increase the fracture toughness of YSZ, and therefore the entire TBC, more effectively than a discrete layer of alumina at the TBC surface, particularly if the particles are dispersed throughout the TBC.

The presence of alumina as discrete particles is also distinguishable from the prior art suggestion for using alumina in the form of discrete layers on individual YSZ grains of a TBC as a corrosion inhibitor. When present as a dispersion throughout the TBC (as opposed to discrete layers), the alumina particles provide uniform resistance to erosion and impact throughout the life of the TBC, including as the TBC erodes.

Suitable methods for depositing the TBC of this invention include plasma spraying and physical vapor deposition techniques. As an example, EBPVD can be used to deposit the TBC and its dispersion of alumina particles by evaporating multiple ingots, at least one of which is YSZ while a second contains alumina and optionally YSZ. In this method, the alumina content of the second ingot is continuously evaporated during the deposition process so that the alumina particles are dispersed throughout the TBC. Alternatively, the TBC can be deposited by evaporating a single ingot containing YSZ and regions of alumina. Another alternative is to evaporate a single ingot of YSZ using a chemical vapor deposition (CVD)-assisted process in which a source of aluminum vapors is continuously introduced into the coating chamber, causing oxidation of the aluminum and deposition of the resulting alumina vapors along with YSZ. Another method is to use an ion beam source of aluminum (cathodic arc source) while evaporating a YSZ ingot to create the dispersion of alumina particles in the YSZ TBC. With each of the alternative methods, the evaporation process is scalable to allow for the use of multiple coating sources.

The resulting TBC is characterized by improved resistance to both erosion and impact as a result of the alumina particles being present in sufficient amounts within the YSZ matrix of the TBC, and without being present as discrete layers on the YSZ grains or the surface of the TBC. As a result of improved erosion and impact resistance, relatively thinner TBC can be used as compared to conventional YSZ TBC to achieve the same service life. The net benefit is improved component life, engine performance and fuel efficiency.

Other objects and advantages of this invention will be better appreciated from the following detailed description.

DETAILED DESCRIPTION OF THE INVENTION

Figure 1:
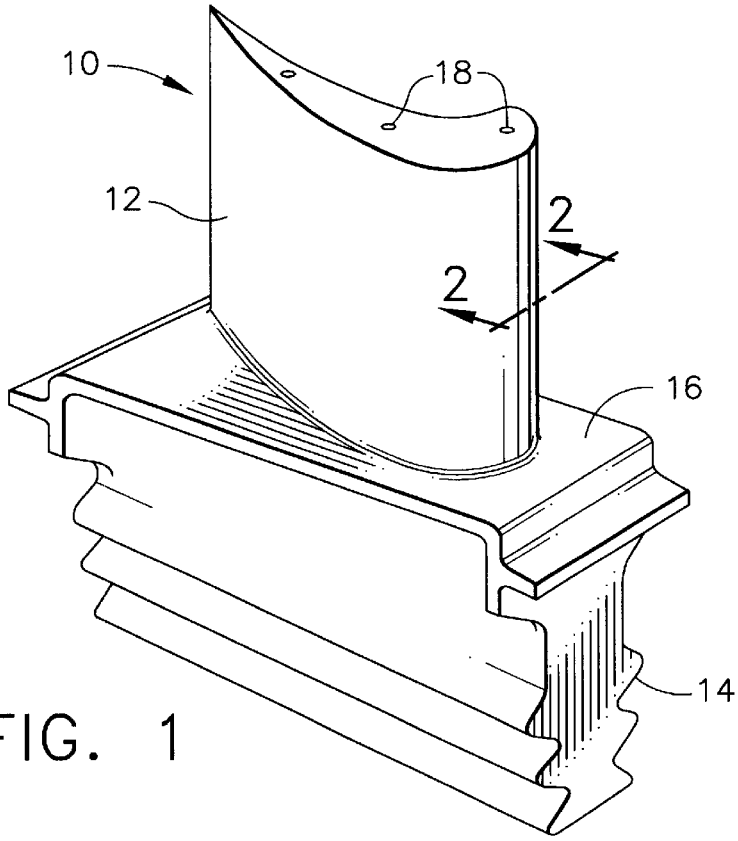
FIG. 1 is a perspective view of a high pressure turbine blade.

The present invention is generally applicable to components subjected to high temperatures, and particularly to components such as the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to hot combustion gases as well as attack by oxidation, corrosion and erosion. The airfoil 12 is protected from its hostile operating environment by a thermal barrier coating (TBC) system 20 schematically depicted in FIG. 2. The airfoil 12 is anchored to a turbine disk (not shown) with a dovetail 14 formed on a root section 16 of the blade 10. Cooling passages 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which a thermal barrier coating may be used to protect the component from a high temperature environment.

Figure 2:
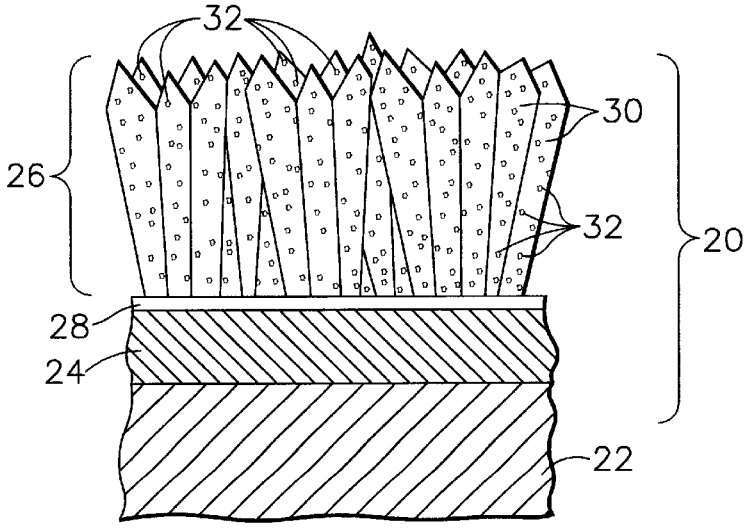
FIG. 2 is a cross-sectional view of the blade of FIG. 1 along line 2—2, and shows a thermal barrier coating system on the blade in accordance with a first embodiment of this invention.

The TBC system 20 is represented in FIG. 2 as including a metallic bond coat 24 that overlies the surface of a substrate 22, the latter of which is typically a superalloy and the base material of the blade 10. As is typical with TBC systems for components of gas turbine engines, the bond coat 24 is an aluminum-rich composition, such as an overlay coating of an MCrAlX alloy or a diffusion coating such as a diffusion aluminide or a diffusion platinum aluminide of a type known in the art. Aluminum-rich bond coats of this type develop an aluminum oxide (alumina) scale 28, which is grown by oxidation of the bond coat 24. The alumina scale 28 chemically bonds a thermal-insulating ceramic layer, or TBC 26, to the bond coat 24 and substrate 22. The TBC 26 of FIG. 2 is represented as having a strain-tolerant microstructure of columnar grains 30. As known in the art, such columnar microstructures can be achieved by depositing the TBC 26 using a physical vapor deposition technique, such as EBPVD. The present invention is particular directed to yttria-stabilized zirconia (YSZ) as the material for the TBC 26. A suitable composition for the YSZ is about 2 to about 20 weight percent yttria, more preferably about 3 to about 8 weight percent yttria. However, the invention is believed to be generally applicable to zirconia-based TBC, which encompasses zirconia partially or fully stabilized by magnesia, ceria, calcia, scandia or other oxides. The TBC 26 is deposited to a thickness that is sufficient to provide the required thermal protection for the underlying substrate 22 and blade 10, generally on the order of about 75 to about 300 micrometers.

Figure 3:
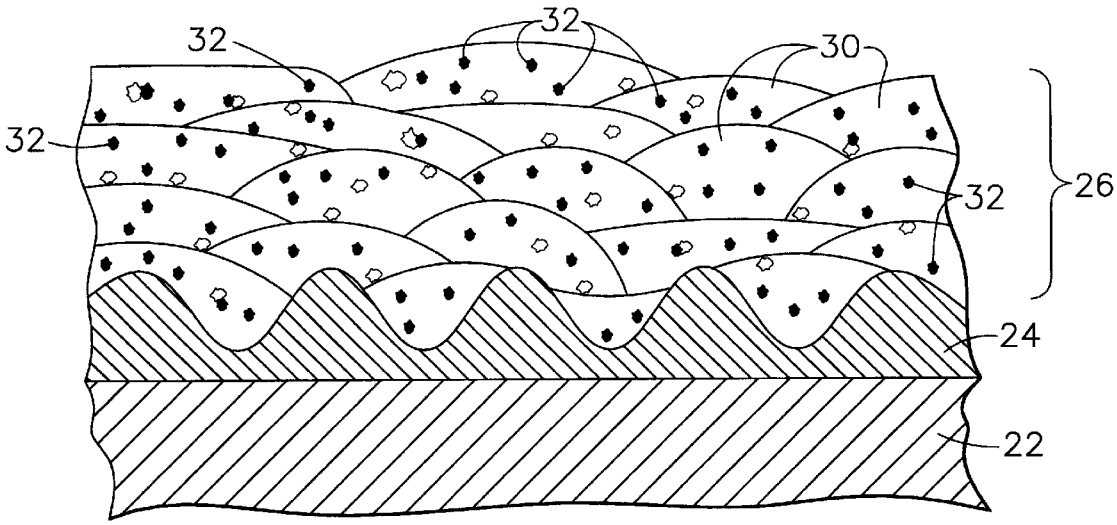
FIG. 3 is a cross-sectional view of a thermal barrier coating system in accordance with a second embodiment of this invention.

While much of the following discussion will focus on columnar TBC of the type shown in FIG. 2, the invention is also believed to be applicable to noncolumnar TBC deposited by such methods as plasma spraying, including air plasma spraying (APS). The microstructure of this type of TBC is represented in FIG. 3, in which the same reference numbers used in FIG. 2 to identify the columnar TBC 26 on a substrate 22 and bond coat 24 are now used to identify a similar substrate 22 and bond coat 24 on which a noncolumnar TBC 26 was deposited by plasma spraying. In the plasma spraying process, TBC material is deposited in the form of molten "splats," resulting in the plasma-sprayed TBC 26 of FIG. 3 having a microstructure characterized by splat-shaped (i.e., irregular and flattened) grains 30 and a degree of inhomogeneity and porosity.

As a result of the process by which the TBC 26 of either FIG. 2 or 3 is deposited, the individual grains 30 of the TBC's 26 are characterized by a uniform dispersion of alumina particles and/or precipitates 32 (hereinafter, particles) within the grains 30 and at and between the grain boundaries. According to the invention, the alumina particles 32 perform the function of improving the fracture toughness of YSZ, which is believed to promote the overall impact and erosion resistance of the TBC 26 if present in sufficient amounts in the form of a fine limited dispersion within the TBC 26, without discrete and homogeneous layers of alumina, and without creating abrupt compositional interfaces that would promote spallation attributable to weak (low-toughness) interfaces between the dissimilar TBC materials (YSZ and alumina). More particularly, the alumina particles 32 are believed to increase the hardness, bend strength, elastic modulus and fracture toughness of the TBC 26. Improved impact resistance of the TBC 26 is believed to result from increased fracture toughness, while improved erosion resistance is believed to occur as a result of increased fracture toughness, fracture strength, bend strength, hardness and elastic modulus of the TBC 26. Additional potential benefits include thermal stabilization of the YSZ, which retards the gradual increase in thermal conductivity observed with YSZ TBC and associated with densification and/or sintering of YSZ at high temperatures, e.g., above 1000 EC. In addition to having hardness, strength (bend, compressive and tensile) and an elastic modulus greater than that of YSZ, the alumina particles 32 are insoluble in YSZ and remain thermodynamically stable with YSZ at elevated temperatures to which the TBC 26 will be subjected within the environment of a gas turbine engine.

The alumina particles 32 are preferably present in an amount of at least 5 volume percent of the TBC 26 in order to contribute to the erosion and impact resistance of the TBC 26. A suitable upper limit is about 40 volume percent so as not to unacceptably embrittle the TBC 26. In a preferred embodiment, the alumina particles 32 are present in a range of about 15 to about 35 volume percent. The particles 32 preferably have diameters on the order of about 100 to about 5000 nanometers, more preferably about 1000 to about 5000 nanometers to promote the erosion and impact resistance of the TBC 26.

A suitable process for depositing the columnar TBC 26 of FIG. 2 is a physical vapor deposition process, alone or assisted by chemical vapor deposition (CVD). A preferred process is believed to be EBPVD, which generally entails loading a component (such as the blade 10 of FIG. 1) to be coated into a coating chamber, evacuating the chamber, and then backfilling the chamber with oxygen and an inert gas such as argon to achieve a subatmospheric chamber pressure. The component is then supported in proximity to one or more ingots of the desired coating material, and one or more electron beams are projected onto the ingot(s) so as to evaporate the ingots and produce a vapor that deposits (condenses) on the component surface. While similar in many respects to conventional EBPVD, the process for depositing the columnar TBC 26 of this invention requires that each TBC coating material (YSZ and alumina) is present within one or more of the ingots. For example, the TBC 26 can be deposited by simultaneously evaporating separate ingots of YSZ and alumina. Alternatively, a single ingot containing YSZ and alumina regions or a dispersion of alumina can be evaporated to produce the TBC 26. Another alternative is to evaporate a single ingot of YSZ using a chemical vapor deposition (CVD)-assisted process in which a source of aluminum vapors is continuously introduced into the coating chamber, causing oxidation of the aluminum and deposition of the resulting alumina vapors along with YSZ. Another alternative method is to use an ion beam source of aluminum (cathodic arc source) while evaporating a YSZ ingot to create the dispersion of alumina particles 32.

A suitable process for depositing the noncolumnar TBC 26 of FIG. 3 is a plasma spraying technique, such as air plasma spraying (APS). Plasma spraying generally entails loading a component (e.g., the blade 10) to be coated into a coating chamber, and then melting a mixture of YSZ and alumina powders in the desired proportion with a plasma as it leaves a spray gun. Alternatively, the powder may be pre-alloyed to contain a mixture of YSZ and alumina. The molten powder particles impact the surface of the component, yielding grains 30 in the form of "splats" as represented in FIG. 3.

For each of the above deposition processes, other process variables or fixturing, such as rotation and masking of a component, can be used to selectively deposit the TBC 26 of this invention on particular surface regions of the component that are relatively more prone to erosion or impact damage. For example, the TBC 26 could be selectively deposited on regions of the leading edge of the blade 10, while conventional YSZ TBC could be selectively deposited on other surface regions of the blade 10.

The deposition processes of this invention are all carried out so that alumina condenses to form the discrete and fine particles 32 represented in FIGS. 2 and 3. Because alumina is not soluble in YSZ, the particles 32 remain as discrete particles that will not alloy with YSZ within the TBC 26. Accordingly, the present invention differs from prior TBC materials sequentially deposited as discrete homogeneous layers or codeposited to form discrete layers surrounding YSZ grains. Finally, the TBC 26 of this invention is characterized by improved resistance to both erosion and impact, yet can be present as a relatively thin coating (e.g., less than 125 micrometers) to improve engine performance, fuel efficiency and component life.

While the invention has been described in terms of a preferred embodiment, it is apparent that other forms could be adopted by one skilled in the art. For example, instead of depositing the TBC 26 by EBPVD or CVD-assisted PVD, other atomic and molecular vapor deposition processes could be used, such as sputtering, ion plasma deposition, and all forms of melting and evaporation deposition processes. Accordingly, the scope of the invention is to be limited only by the following claims.

What is claimed is:

1. An airfoil comprising a thermal barrier coating having a portion thereof on a leading edge surface of the airfoil, the leading edge surface being relatively more prone to erosion and impact damage than a second exposed surface of the airfoil, the portion of the thermal barrier coating consisting of at least partially stabilized zirconia and a dispersion of alumina particles, the portion of the thermal barrier coating having a noncolumnar and inhomogeneous microstructure comprising the alumina particles dispersed among irregular and flattened zirconia grains, the alumina particles being smaller than the zirconia grains so that at least some of the alumina particles are located within the grains and have diameters in a range of about 100 to 5000 nanometers.

2. An airfoil according to claim 1, wherein the zirconia is at least partially stabilized by about 2 to about 20 weight percent yttria.

3. An airfoil according to claim 1, wherein the zirconia is partially stabilized by 3 to 8 weight percent yttria.

4. An airfoil according to claim 1, wherein the alumina particles constitute at least 5 volume percent of the thermal barrier coating.

5. An airfoil according to claim 1, wherein the alumina particles constitute about 5 to about 40 volume percent of the thermal barrier coating.

6. An airfoil according to claim 1, wherein the alumina particles constitute about 15 to about 35 volume percent of the thermal barrier coating.

7. An airfoil according to claim 1, wherein the alumina particles have diameters in a range of about 100 to less than 500 nanometers.

8. A gas turbine engine blade having a leading edge surface that is relatively more prone to erosion and impact damage than a second exposed surface of the blade, the blade comprising:

a superalloy substrate;

a metallic bond coat on the substrate;

a first thermal barrier coating on the bond coat at the leading edge surface, the first thermal barrier coating having a noncolumnar and inhomogeneous microstructure comprising irregular and flattened grains, the first thermal barrier coating consisting of yttria-stabilized zirconia and about 5 to about 40 volume percent alumina particles having diameters in a range of about 100 to less than 500 nanometers, at least some of the alumina particles being located within the grains, the first thermal barrier coating being on the leading edge surface and not on the second exposed surface of the airfoil; and a second thermal barrier coating on the bond coat at the second exposed surface, the second thermal barrier coating being free of alumina particles.

9. A gas turbine engine blade according to claim 8, wherein the yttria-stabilized zirconia contains about 2 to about 20 weight percent yttria.

10. A gas turbine engine blade according to claim 8, wherein the yttria-stabilized zirconia contains 3 to 8 weight percent yttria.

11. A gas turbine engine blade according to claim 8, wherein the alumina particles constitute about 15 to about 35 volume percent of the thermal barrier coating.

* * * * *